US005642757A

United States Patent [19]

Froment et al.

[11] Patent Number: 5,642,757

[45] Date of Patent: Jul. 1, 1997

[54] MOTOR CONTROLLED DRIVE FOR SHED-FORMING SYSTEMS IN WEAVING LOOMS

[75] Inventors: Jean-Paul Froment, Doussard; Patrick Iltis, Saint-Jorioz, both of France

[73] Assignee: Staubli Faverges, Faverges, France

[21] Appl. No.: 626,040

[22] Filed: Apr. 1, 1996

[30] Foreign Application Priority Data

Apr. 5, 1995 [FR] France ..... 95 04289

[51] Int. Cl.[6] ..... D03C 3/32; D03C 3/00; D03D 51/02

[52] U.S. Cl. ..... 139/1 E; 139/59

[58] Field of Search ..... 139/59, 1 E

[56] References Cited

U.S. PATENT DOCUMENTS 4,474,219 10/1984 Froment ..... 139/1 E 4,986,315 1/1991 Borisch et al. ..... 139/1 E

FOREIGN PATENT DOCUMENTS 0087519 9/1983 European Pat. Off. ..... 139/59

3249233 11/1991 Japan ..... 139/59

*Primary Examiner*—Andy Falik

*Attorney, Agent, or Firm*—Dowell & Dowell

[57] ABSTRACT

In a shed-forming system of a weaving loom the drive shaft thereof is driven by an independent motor with controlled variable input which will depend upon the weaving program, the current forces on the components of the shed-forming system and constant forces inherent in the shed-forming system operation and by a second input shaft which synchronizes the drive shaft with the principal drive shaft of the loom.

5 Claims, 3 Drawing Sheets

MOTOR CONTROLLED DRIVE FOR SHED-FORMING SYSTEMS IN WEAVING LOOMS

FIELD OF THE INVENTION

The present invention relates to systems for forming the shed on weaving looms, and more particularly (as it is in this case that its application appears to present the greatest interest), but not exclusively, to those of the Jacquard type.

HISTORY OF THE RELATED ART

It is known that the systems of this type are conventionally driven from the weaving loom with which they are associated; in fact, the drive shaft of the system is connected to the principal shaft of the loom by a vertical transmission shaft and two bevel gears (conical couples). This conventional arrangement involves having to equip the loom with a very powerful motor associated with a clutch and an automatic brake, themselves provided to be high-power; the transmission shaft must be of large dimension, with the result that the total cost of the drive system is high.

With a view to overcoming this drawback, document FR-A-2 660 672 (STAUBLI) proposed driving the drive shaft of the system directly with the aid of an independent motor, associated on the one hand, with two coders cooperating respectively with said shaft and the principal shaft of the loom, on the other hand, with an electronic variator arranged to supply the independent motor with power in synchronization with that of the loom as a function of the data received from said coders.

Despite the performances obtained, such a system incorporating a servo-controlled independent motor has not been entirely satisfactory. In effect, energy-consumption is high and, furhermore, serious difficulties in obtaining a perfect synchronization between the loom and the system have been encountered. Such synchronization requires the use of high-definition, therefore expensive and delicate, coders. If the indispensable overdimensioning of the independent motor is added to this, the cost of the system remains high.

Before setting forth the solution proposed by the present invention for the drive of the weaving systems, it will be recalled that the present Jacquard systems most often incorporate electronic reading and consequently have a programmed controller. This controller includes a memory in which is stored the desired type of weave and, receiving the system position data, it controls the reading of the latter at each pick, in order to control the ascending and descending movements of each of the heddles of the harness.

This having been set forth, it will be indicated that the purposes of the present invention are to reduce energy consumption, to obtain a perfect synchronization between weaving system and weaving loom, to eliminate the need for high-definition coders and to reduce the cost of the loom.

SUMMARY OF THE INVENTION

To that end, the present invention relates to a system for driving the shed-forming systems on weaving looms, characterized in that it comprises, for actuating the drive shaft of the system, on the one hand, an independent motor with controlled variable couple, not servo-controlled by the principal shaft of the loom, on the other hand, a synchronization shaft connected to said principal shaft.

This duality of motive sources for driving the system without electrical servo-control by the loom has considerable practical advantages:

- the synchronization shaft transmits only a very low couple, force with the result that it can have a reduced cross-sectional dimension;

- the power is localized very close to the system and therefore does not transit through the loom;
- very high operational speeds may be attained with a heavily loaded weaving loom and weaving system;
- the cost price of the whole drive system is substantially reduced with respect to prior-art solutions.

According to a particularly advantageous embodiment of the invention, the coupling-drive of the independent motor is controlled with the aid of an electronic variator associated with a calculator arranged so as suitably to process the data received from the system controller. This calculator determines at each instant the couple as a function of the elastic unbalances detected by the controller.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
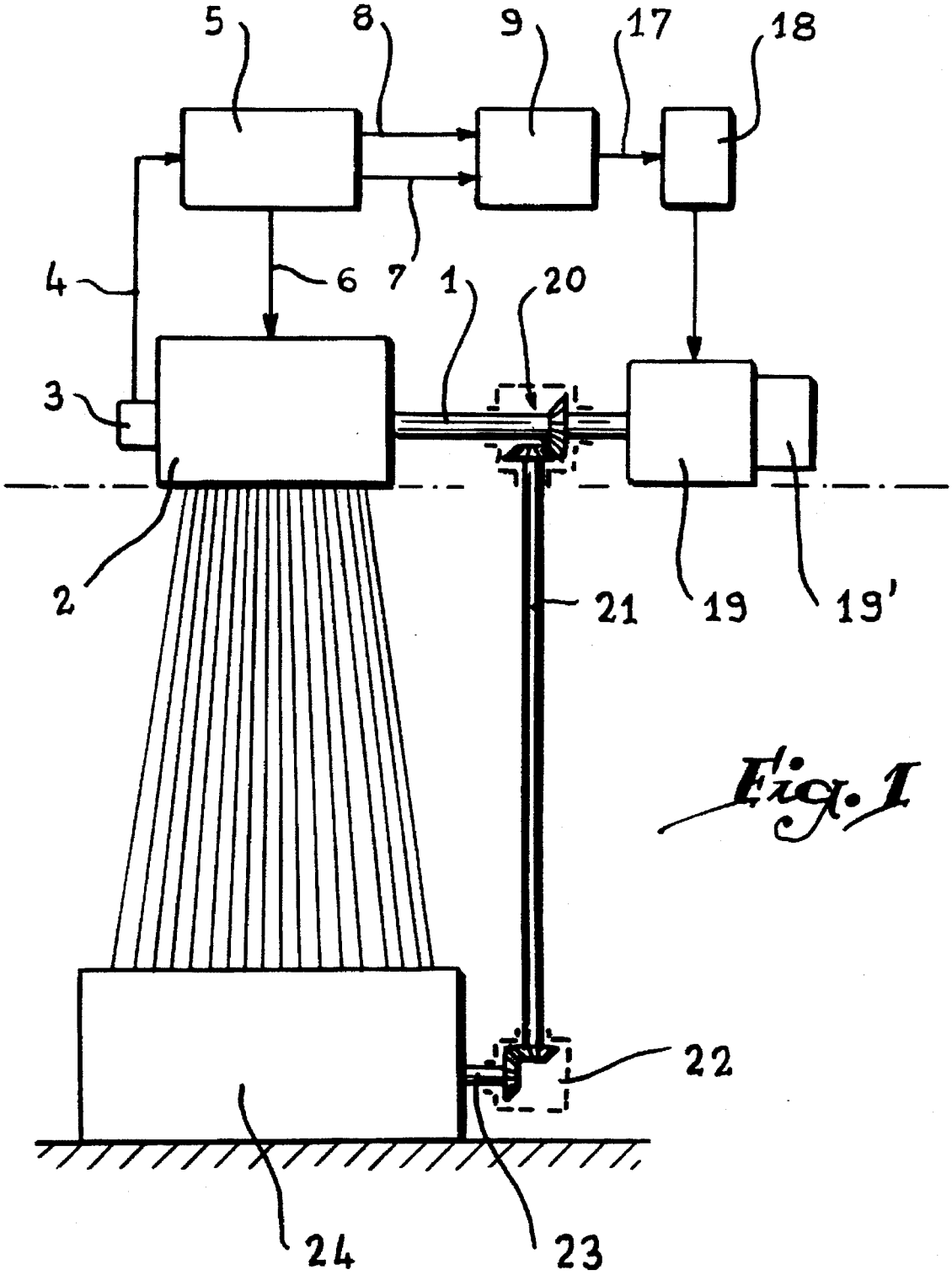
FIG. 1 is a diagram illustrating the general arrangement of a drive system for a Jacquard system according to the present invention.

Referring now to the drawings, and firstly to FIG. 1, reference 1 designates the drive shaft which ensures drive of the Jacquard system shown schematically at 2. This system 2 is equipped with a coder 3 which detects the rotational position of the shaft 1 at any moment and which sends the corresponding data 4 to the controller 5 which effects electronic reading of the weaving program entered into the controller, in order to send the weaving data or signals for controlling the weave pattern 6 to the system 2.

Figure 2:
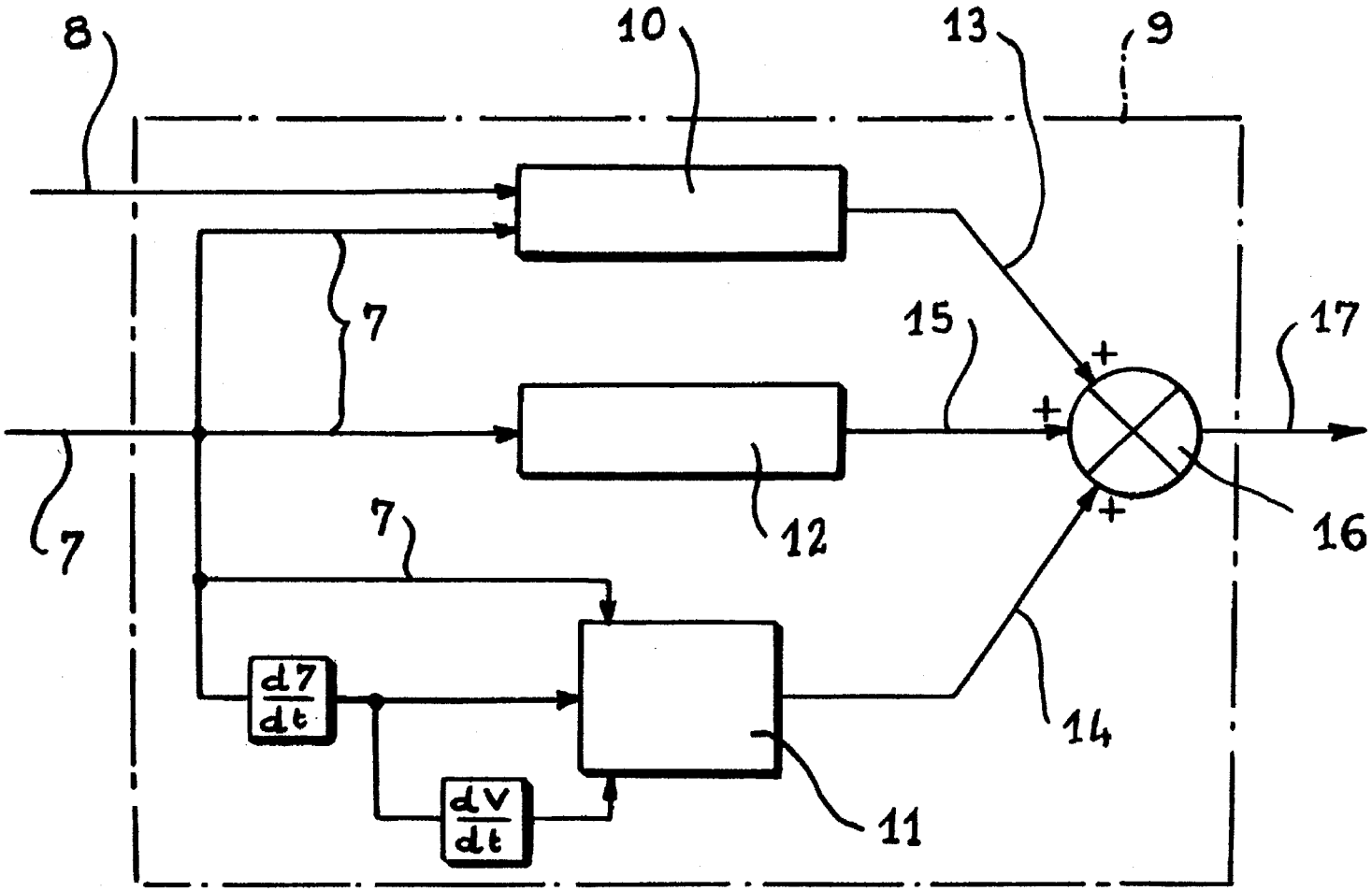
FIG. 2 similarly shows the arrangement of the calculator for controlling the couple variator associated with the independent motor.

Simultaneously, the controller 5 sends the position data 7 and weaving data 8 to a calculator or computer 9 whose functional arrangement has been illustrated in FIG. 2.

As shown, this calculator 9 contains three modules referenced 10, 11 and 12, which all receive the rotational position data 7 provided by the controller 5:

- module 10 stores in memory the characteristics of all the return springs associated with the heddles of the harness of the system 2, with the result that, knowing at any moment the rotational position (data 7), the return effort or force of each spring as a function of the position in height of the heddle in question, and the direction of displacement of the heddles (weaving information 8), it can calculate the unbalanced forces or torques at each instant as a function of the difference of elastic return efforts between the heddles which rise and the heddles which descend;
- module 11 stores in memory the inertias of the parts of the shed-forming system to be driven and it may calculate on the one hand the speed of these parts as a function of the variation of the angular position 7 in time t (value d7/dt), on the other hand the acceleration of said parts as a function of the variation of speed (dV/dt), these values enabling the inertia force to be calculated;
- finally, module 12 takes into account memorized or inputted constant forces, for example the constant or frictional forces.

Data 13 (unbalance forces), 14 (inertia forces) and 15 (constant forces) respectively supplied by modules 10, 11 and 12 of the calculator 9 are sent to an electronic adder or comparator 16 in which they are added in order to define the data 17 corresponding to the resultant forces on the system.

This data 17 is sent to the variator 18 of an independent motor 19 (FIG. 1) equipped with an automatic brake 19', which motor 19 drives the drive shaft 1 of the system 2. Between motor 19 and the system 2, the shaft 1 is provided with bevel gears 20 which link with a vertical synchronization shaft 21 whose base is connected by other bevel gears 22 to the principal drive shaft 23 of the weaving loom 24.

The drive shaft 1 of the system 2 is consequently driven by two distinct motive sources 19 and 23, the respective values of the forces exerted on said shaft 1 by these two sources varying at any moment as a function of the resultant force 17.

Figure 3:
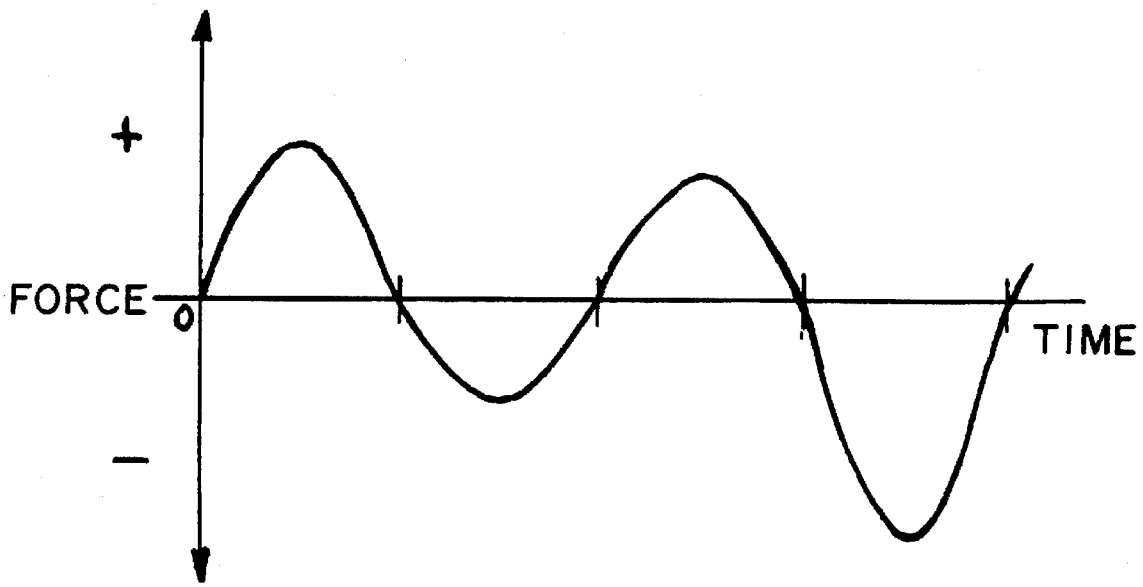
FIGS. 3 and 4 illustrate the variations of the resultant couple developed by the system, respectively of the couple furnished by the independent motor and by the synchronization shaft.

The latter force varies considerably as a function of the weaving program, such variation being made in both directions (positive of the motor, negative of the receiver), as illustrated in the diagram of FIG. 3 showing the succession of the strokes (introduction of the picks) of the loom 24 as a function of the weave pattern. It will be appreciated that if this resultant force 17 is calculated sufficiently precisely, the independent motor 19 provides the majority of the power transmission applied to the drive shaft 1, while the synchronization shaft 21 will serve only to compensate for errors of calculation and the instantaneous variations of the speed of the loom.

Figure 4:
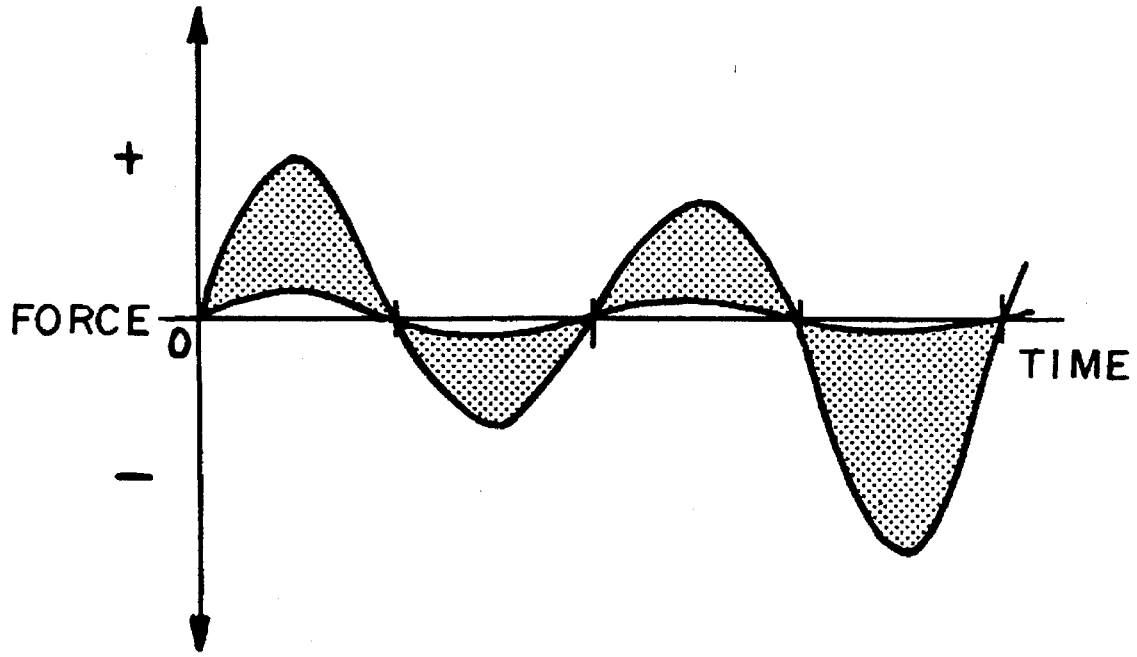

FIG. 4 shows in stippling that part of the force furnished by the motor 19 and, in light areas, the small part of the force transmitted by the synchronization shaft 21. Such division of the forces is very favorable since it enables a perfect synchronization to be obtained between the input 23 to the loom 24 and the input 1 to the system 2 with the aid of the single detector 3, of conventional type; energy-consumption is substantially reduced and the general cost is lowered.

It will be appreciated that the system according to the invention is applicable to systems of the dobby type if an appropriate controller is incorporated.

What is claimed is:

1. A system for driving the shed-forming system in a weaving loom having a primary loom drive shaft and wherein the shed-forming system includes an input drive shaft, a controller for reading weaving input programs and thereby controlling the movement of components of a harness including a heddle dependent upon the weaving input programs and a detector for detecting the rotational position of the input drive shaft for inputting detected rotational information to the controller, the system for driving comprising, a motor for directly driving the input drive shaft at variable speeds, and a synchronization drive shaft for drivingly connecting the primary loom drive shaft to the input drive shaft whereby the input drive shaft is subject to drive inputs from both said motor and the primary loom drive shaft.

2. The system for driving of claim 1 wherein said motor is controlled by an electronic variator which receives control signals based upon input data from a calculator which functions to interpret data received from the controller.

3. The system for driving of claim 2 in which said input data includes data with respect to constant forces on the shed-forming system, data with respect to unbalanced forces associated with the movement of the heddle, and data with respect to inertia forces based upon the velocity and acceleration of components of the shed-forming system.

4. The drive system of claim 3 including an adder for receiving and summing said input data and for sending control signals to said electronic variator.

5. A system for driving the shed-forming system in a weaving loom having a primary loom drive shaft and wherein the shed-forming system includes an input drive shaft, a controller for reading weaving input programs and thereby controlling the movement of components of a harness including a heddle dependent upon the weaving input programs, the system for driving comprising, a detector for detecting the rotational position of the input drive shaft for inputting detected rotational information to the controller, a motor for directly driving the input drive shaft at variable speeds, and a synchronization drive shaft for drivingly connecting the primary loom drive shaft to the input drive shaft whereby the input drive shaft is subject to drive inputs from both said motor and the primary loom drive shaft.

* * * * *